United States Patent [19]

Morey

[11] 4,351,719

[45] Sep. 28, 1982

[54] VIBRATING SCREEN APPARATUS

[75] Inventor: Larry L. Morey, Mount Pleasant, Mich.

[73] Assignee: Morbark Industries, Inc., Winn, Mich.

[21] Appl. No.: 236,032

[22] Filed: Feb. 19, 1981

[51] Int. Cl.[3] ..... B07B 1/28; B07B 9/00

[52] U.S. Cl. ..... 209/234; 209/244; 209/267; 209/315; 209/365 C; 209/366; 209/397

[58] Field of Search ..... 209/234, 311, 315, 317, 209/325, 326, 329, 365 R, 365 C, 366, 392, 397, 409, 257, 267, 244, 316, 318, 319, 341, 330

[56] References Cited

U.S. PATENT DOCUMENTS

| | | | |
|---|---|---|---|
| 297,382 | 4/1884 | Golding | 209/397 |
| 2,020,013 | 11/1935 | Bailey | 209/365 B X |
| 2,297,486 | 9/1942 | Linke et al. | 209/311 X |
| 2,901,111 | 8/1959 | Eppenberger | 209/326 X |
| 3,087,618 | 4/1963 | Musschoot et al. | 209/329 |

FOREIGN PATENT DOCUMENTS

| | | | |
|---|---|---|---|
| 578541 | 6/1933 | Fed. Rep. of Germany | 209/257 |
| 300493 | 9/1932 | Italy | 209/315 |

*Primary Examiner*—Ralph J. Hill

*Attorney, Agent, or Firm*—Learman & McCulloch

[57] ABSTRACT

A vibratory screen apparatus is employed to continuously separate particles of random sizes, such as wood chips, into groups large, medium and small sized particles. A vibratory frame has a horizontal platform driven in vibratory movement to convey particles on the platform to one end of the platform. Upper and lower inclined screens are mounted upon the platform, particles are fed to the upper end of the upper screen which will pass medium and small sized particles passing through the lower screen to the platform. Gravitational movement of particles down the inclined upper screen is delayed by the vibratory movement of the screen; abutment surfaces on the upper surface of the upper screen imparting intermittent upward movement to particles on that surface which resists, but does not overcome gravitationally induced flow of the particles.

7 Claims, 7 Drawing Figures

VIBRATING SCREEN APPARATUS

BACKGROUND OF THE INVENTION

In the past, the paper-making industry has used substantial quantities of wood chips which were produced from debarked logs. In 1970, a new chipping apparatus was first introduced, see U.S. Pat. No. 3,661,333, which was capable of reducing an entire tree, with attached limbs and branches, to chips. Although originally designed to serve as a tree-destroying apparatus to simplify removal of trees as chips, rather than bulley limbs and branches, as in land clearing operations or removal of diseased or dead trees from city streets, it was immediately recognized that in performing its function the machine of U.S. Pat. No. 3,661,333 produced large quantities of wood chips which would be useful in the papermaking industry. However, the paper-making industry requires chips of a substantially uniform size and the chips produced by the machine of U.S. Pat. No. 3,661,333 because of the relatively thin branches and twigs present on the undelimbed trees which it handled, produced chips which included chips of widely varying sizes and dimensions.

The prior practice of the paper-making industry in employing debarked logs as the material from which chips were produced enabled the production of chips of the desired uniform size in that the chipper always operated on material of uniform cross-section from which the bark had previously been removed. However, this process required the removal of all limbs from the felled tree and the subsequent removal of the bark from the delimbed log. The delimbing of the felled tree and the subsequent debarking of the log were relatively costly steps in terms of the labor and equipment involved; further, many of the delimbed and debarked logs so produced represented merchantable timber which would have substantially greater value as lumber rather than paper pulp. The machine of U.S. Pat. No. 3,661,333 on the other hand, largely handled trees having little or no economic value as lumber, however, the chips produced by such machine found those chips usable by the paper-making industry intermixed with substantial quantities of over or under sized chips, bark, and finely shredded leaves and small twigs.

While this mixture of usuable and unusable chips immediately suggested a screening or separating operation to cull the good chips from the bad, some difficulty was encountered in achieving an efficient chip separating operation. In order to be feasible, the screening operation had to be capable of handling large quantities of wood chips which meant that relatively large quantities of chips were dumped upon the first or coarse separating screen. With a layer of chips several layers deep on the coarse separating screen, the larger chips tended to exert a clogging effect on the coarse screen and unless this first stage of separation was a very thorough one, substantial quantities of usable chips were carried off the coarse separating screen by the larger chips. Efforts to resolve this problem usually involved the employment of relatively large area coarse screens combined with a relatively slow transit time of wood chips across the screen, both of these characteristics representing an economic penalty.

The present invention is directed to this latter problem and provides a vibratory screen apparatus of relatively simple and compact construction which efficiently separated chips of a usable size from other chips of larger and smaller sizes.

SUMMARY OF THE INVENTION

A chip separator or classifier embodying the present invention includes a vibratory frame having a flat horizontal platform and a pair of inclined screens located one above the other and overlying the horizontal platform. The upper of the two inclined screens takes the form of an expanded metal mesh having openings sized to retain larger chips on its upper surface while permitting chips of the desired size and the fines to pass through the mesh onto the inclined surface of the underlying screen. The underlying screen in turn has openings sized to retain chips of the desired size while passing the fines, which drop onto the surface of the underlying horizontal platform. The vibratory frame defined by the two inclined screens and the horizontal platform is driven in vibratory movement along a generally eliptical path whose major axis is generally parallel to the inclination of the screens. This particular motion constitutes the horizontal platform as a vibratory conveyor which will advance the fines which fall on its surface toward that end of the platform which underlies the elevated ends of the inclined screens.

Chips to be separated are discharged from a hopper onto the upper end of the upper screen. The expanded metal mesh which constitutes the upper screen is mounted in a manner such that the mesh presents a series of abutments which face the upper end of the screen, thus as the screen is vibrated and expanded metal mesh attempts to convey chips on its upper surface toward the upper end of the screen. However, the slope at which the upper screen is inclined is chosen to be steep enough so that this upward conveying action exerted by the vibrating expanded metal mesh upon the chips is overcome by the gravitational bias urging the chips toward the lower end of the inclined upper screen. Effectively, the vibrating action of the screen opposed, but does not overcome, the gravitational movement of chips down the upper surface of the upper screen, thus effectively increasing the time it takes a chip to pass from the upper end of the screen to the bottom or discharge end. This delaying action enables the upper screen to effectively remove all of the chips of the desired size and smaller from the larger chips while employing an upper screen of relatively compact dimensions.

Other objects and features of the invention will become apparent by reference to the following specification and to the drawings.

IN THE DRAWINGS

Figure 1:
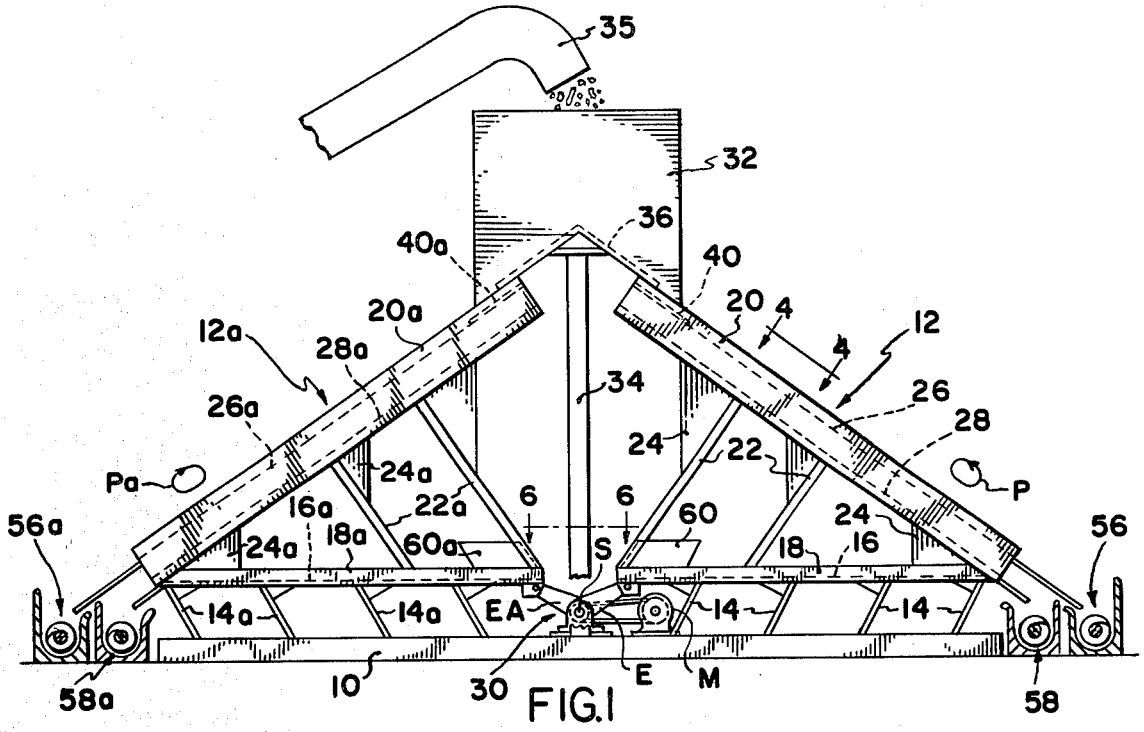
FIG. 1 is a side elevational view of a vibrating screen apparatus embodying the present invention with certain parts broken away, omitted, or shown schematically.
Figure 2:
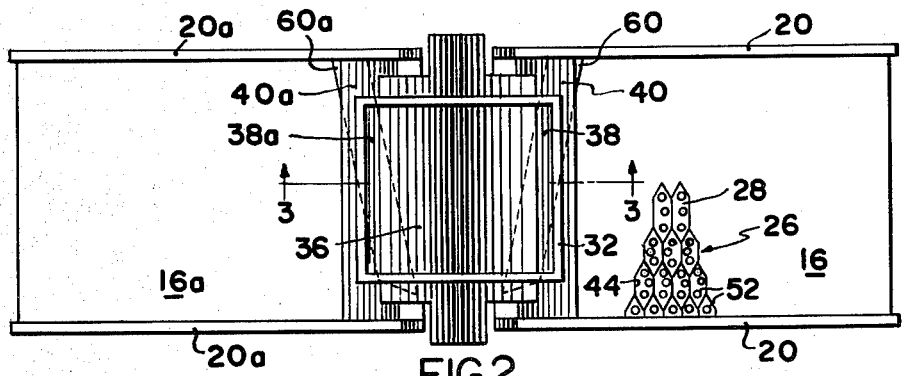
FIG. 2 is a top plan view of the apparatus of FIG. 1.

Referring first to FIG. 1, an apparatus embodying the present invention is shown as including a fixed frame or base designated generally 10 upon which a pair of vibratory frames designated generally 12, 12*a* are supported for vibratory movement by a plurality of inclined leaf springs 14, 14*a*. Vibratory frames 12 and 12*a* are of substantially identical construction, elements of vibratory frame 12*a* being identified by the same reference numerals employed in the following description of vibratory 12, the reference numerals for elements of frame 12*a* having a subscript a.

Vibratory frame 12 includes a horizontal platform 16 of rectangular shape having side rails 18 projecting above the surface of platform 12 along the two longer sides of platform 16. Overlying platform 16 is an upwardly inclined open rectangular framework which includes a pair of spaced parallel side members 20 fixedly secured to each other by cross frame members, not shown. The upwardly inclined frame including side frame members 20 is supported upon platform 16 by inclined fixed frame members 22 and bracing webs 24 which rigidly interconnect side frame members 20 to platform 16. Supported between side frame members 20 are two vertically spaced screens 26 and 28. The screens 26 and 28 at their lower ends project slightly beyond the righthand end of platform 16 as viewed in FIG. 1.

Figure 6:
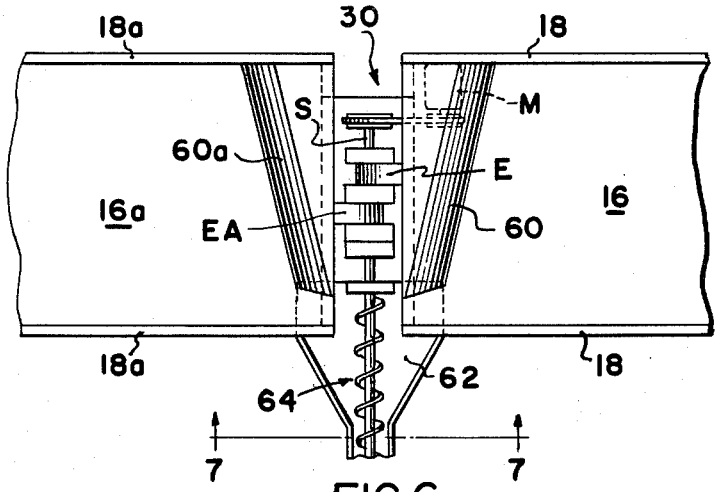
FIG. 6 is a top plan view of a portion of the apparatus taken approximately from the line 6—6 of FIG. 1.

To drive the vibratory frames 12 and 12*a* in vibratory movement, a drive mechanism schematically identified at 30 in FIG. 1 and shown in somewhat greater detail in FIG. 6 is employed. Drive mechanism 30 includes a motor M coupled to drive a shaft S mounted to rotatate about a horizontal axis on fixed frame 10. Shaft S carries a pair of eccentrics E, Ea which are respectively coupled to vibratory frames 12 and 12*a* to drive the respective frames in vibratory oscillation upon rotation of shaft S by motor M. This type of vibratory drive is well-known and, in combination with the leaf spring mountings 14, 14*a* of vibratory frames 12 and 12*a* causes the entire frame to vibrate both horizontally and vertically in a fashion such that any point on vibratory frame 12 follows a generally eliptical path as indicated at P in FIG. 1. As shown in FIG. 1, the paths P and Pa have their major axes inclined in a direction substantially parallel to that of the associated screens. This particular type of vibratory movement is conventionally used in vibratory conveying systems to convey small particles across a horizontal vibrating surface, the particles being moved in that direction in which the vibratory path is upwardly inclined. Thus, any particles which might rest upon the horizontal platform 16 of vibratory frame 12 would be conveyed by such vibratory action toward the left-hand edge of platform 16 as viewed in FIG. 1, similarly particles on platform 16*a* would be conveyed toward the right-hand edge of this latter platform as viewed in FIG. 1.

Figure 3:
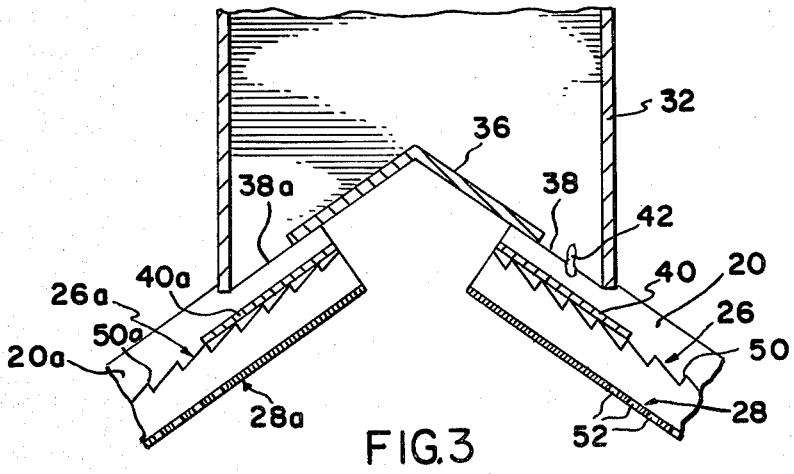
FIG. 3 is a detail cross-sectional view taken on the line 3—3 of FIG. 2.

A hopper 32 is fixedly supported, as by posts 34, to overlie the respective upper ends of screens 26 and 26*a* to receive a stream of wood chips to be separated, as from a chip blower whose spout is indicated at 35 in FIG. 1 and to discharge the chips onto the upper ends of screens 26. An inclined baffle 36 within hopper 32 blocks the open space between the upper ends of screens 26 and directs the chips to discharge openings 38 and 38*a* which overlie screens 26 and 26*a*. As best seen in FIG. 3, preferably a metal plate 40 is mounted upon screen 26 to underlie opening 38 so that long, narrow wood chips such as 42, which it is desired to capture on the top of screen 26, would not pass through the openings of that screen if they were discharged lengthwise at the screen.

Figure 4:
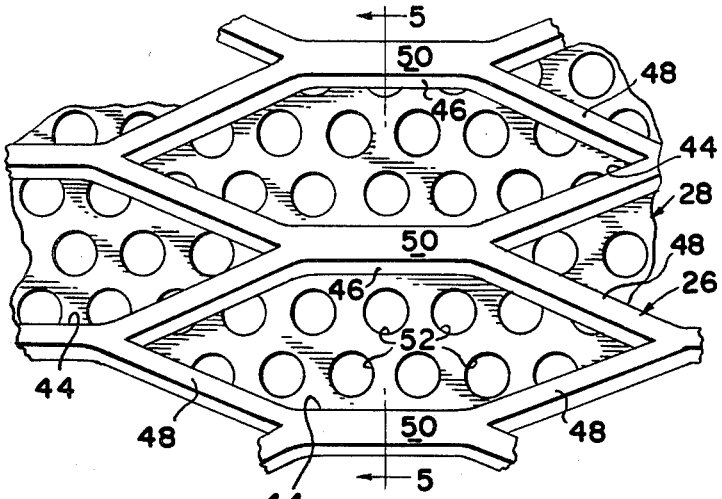
FIG. 4 is a detail top plan view of a portion of the screens of the apparatus, taken approximately from the position 4—4 of FIG. 1.
Figure 5:
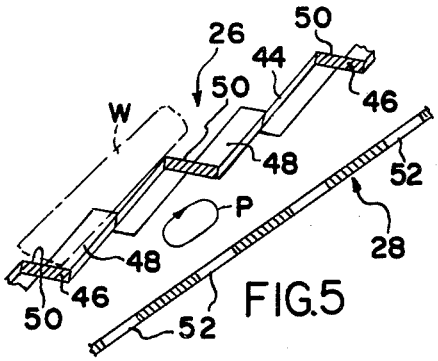
FIG. 5 is a detail cross-sectional view taken on the line 5—5 of FIG. 4.

Constructional details of screens 26 and 28 are best shown in FIGS. 4 and 5.

Screen 26 is constructed from an expanded metal mesh which, as best seen in FIG. 4, presents a series of generally hexagonal openings 44. The expanded metal mesh is formed from sheet metal by a well-known process which, when completed, finds aligned rows and columns of web sections 46 integrally interconnected by what might be called half web sections 48. The mesh is formed in such a manner that the various web sections 46 and 48 are inclined, as best seen in FIG. 5, to the general plane of mesh, so that, when viewed from the side, the mesh presents a sort of saw tooth-like configuration. The expanded metal mesh is mounted between side frames 50 in an orientation such that the exposed upper faces 50 of web sections 46 face the upper end of the inclined screen to form a series of upwardly facing abutment surfaces which will be engaged by the downwardly moving wood chip particles W as indicated in FIG. 5. When such engagement occurs when screen 26 is in a portion of its vibratory cycle there it is moving upwardly to the right as viewed in FIG. 5, this engagement between the chip and abutment surface 50 will impart an upward movement to the chip, and this action is employed to slow the rate of flow of wood chips downwardly along upper screen 26.

Lower screen 28 is formed from a piece of sheetmetal simply by punching openings 52 of the desired size through the metal sheet.

In operation, wood chips of random sizes are supplied to hopper 32, as by chip spout 35, and are distributed by the hopper onto the upper surfaces of upper screens 26, 26*a*. For purposes of explanation, three types of wood chips will be identified as A, B, or C chips. "A" chips will be defined as oversized chips who have at least one dimension exceeding a selected maximum dimension. "B" chips will be defined as those chips whose maximum dimension falls between a selected maximum and a selected minimum dimension, while "C" chips are those chips whose maximum dimension is less than the selected minimum for a B chip. Because the wood chips, as produced, are of very irregular shape, particularly where they are produced from a whole tree including limbs and branches as by the machine of U.S. Pat. No. 3,661,333, for practical purposes classification is based on the single maximum dimension of the chip, in whatever direction measured.

The openings in screen 26 are so sized or dimensioned that B and C chips can pass through the openings 44 in screen 26, but A chips will be retained on the top of the screen. Similarly, B chips will be retained on the top of screen 28, but openings 52 will permit the passage of all C chips and fines, which fall through openings 52 onto platform 16. The inclination of screens 26 and 28 is such that chips supported on the screens will gravitationally slide down the upper surface of the screen to the lower end of the screen where the chips are collected as by auger conveyors indicated at 56,58 in FIG. 1. However, as previously described, this gravitational flow of the chips downwardly along screens 26 and 28 is opposed by the vibratory motion of the screens, particularly in the case of screen 26 whose abutment surfaces 50 actively oppose such gravitational flow. The vibratory motion of the abutment surfaces 50 of screen 26 not only increase the agitation of the flowing chips, but also reduces the over-all rate of flow of the chips to the discharge end of the screen, thus intensifying the separating action exerted by screen 26.

Figure 7:
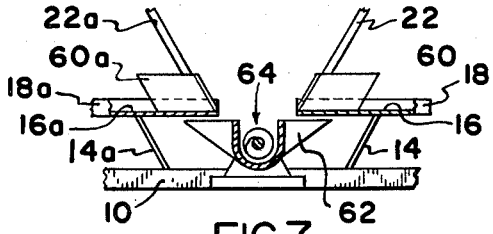
FIG. 7 is a cross-sectional view taken on the line 7—7 of FIG. 6.

The C chips and fines which fall upon platform 16 find themselves upon a horizontal surface and the conveying action exerted by the vibratory motion of this surface will convey the chips and other particles on that surface toward the center of the appartus as viewed in FIGS. 1 and 6. Because a major portion of the vibratory drive for screens 12 and 12*a* is at the location toward which the flow of chips on platforms 16 and 16*a* is directed, a pair of dams 60, 60*a* are mounted on the upper sides of the respective platforms 16, 16*a*, as best seen in FIGS. 6 and 7. Dams 60 and 60*a* are inclined to deflect chips moving across platform 16 and 16*a* toward one side of the platform to a location clear of the vibratory drive 30, the chips then falling from the respective platforms into the hopper 62 of an auger conveyor designated generally 64 in FIG. 6.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

What is claimed is:

1. In a vibratory screen apparatus for separating wood chips, elongate and other overs, and fines into groups of relatively large A particle overs, medium sized B particle chips and relatively small C particle fines, said apparatus including a fixed frame, a vibratory frame mounted for vibratory movement on said fixed frame, and drive means for driving said vibratory frame in vibratory movement on said fixed frame; vertically spaced upper and lower co-extending screens mounted upon said vibratory frame, said screens being inclined upwardly from lower ends to upper ends disposed generally vertically above the lower ends, conveying means for depositing wood chip material of random sizes upon the upper surface of said upper screen adjacent the upper end thereof, said upper screen having openings therethrough sized to permit B and C particles to pass through said upper screen while retaining A particles on the upper surface thereof and said lower screen having openings therethrough sized to permit C particles to pass through said lower screen while retaining B particles on the upper surface thereof, said lower screen comprising rows of laterally spaced apart fine passing openings; said upper screen comprising vertically extending rows of vertically spaced and aligned transversely extending elongate horizontal abutment bars, each joined at its end by a divergent bar to two such horizontal bars in the adjacent row and each bar spanning several laterally spaced openings in the lower screen, and means vibrating the screens to oppose gravitational flow of the material so that the bars intercept and impart intermittent upward movements to the material.

2. The invention defined in claim 1 wherein said vibratory frame includes a generally horizontal imperforate platform underlying said screens, and the structure further comprises first means underlying said platform for receiving C particles, second means underlying said lower end of said lower screen for receiving B particles, and third means underlying said lower end of said upper screen for receiving A particles.

3. The invention defined in claim 1 wherein the inclination of said upper screen is such that the intermittent upward movements imparted to overs on said screen by the vibratory movement of said horizontal bars are exceeded by the gravitationally induced movement of said particles downwardly along the inclined upper screen.

4. The invention defined in any one of claims 1, 2 or 3 further comprising a plurality of flat metal leaf spring members fixedly mounted at their lower ends on said fixed frame and fixedly secured at their upper ends to said platform to support said vibratory frame for vibratory movement on said fixed frame, said spring members being inclined generally normal to the general plane of said upper screen.

5. The invention defined in claim 1 wherein said lower screen comprises a smooth surfaced member of sheet material having openings therethrough.

6. The invention defined in claim 1 wherein said apparatus comprises a pair of said vibratory frames mounted on said fixed frame in adjacent opposed relationship to each other with said opposite ends of the respective platforms of said pair of vibratory frames in adjacent spaced parallel relationship to each other, said conveying means commonly overlying the upper ends of the upper screens of both of said vibratory frames.

7. The invention defined in claim 6 wherein each of said vibratory frames is supported for vibratory movement upon said fixed frame by a plurality of flat leaf spring members inclined generally normal to the general plane of the associated upper screen, and means connecting said drive means to both of said vibratory frames to drive said frames in synchronized vibratory movement.

* * * * *